US005601320A

United States Patent [19]

Miller

[11] Patent Number: 5,601,320

[45] Date of Patent: Feb. 11, 1997

[54] TWO PIECE PORTABLE DOORSTOP

[76] Inventor: Earnest G. Miller, 325 Comanche Rd., Shelbyville, Ky. 40065

[21] Appl. No.: 567,667

[22] Filed: Dec. 5, 1995

[51] Int. Cl.[6] ..... E05C 17/54

[52] U.S. Cl. ..... 292/343; 292/339; 292/DIG. 15

[58] Field of Search ..... 292/339, 338, 292/343, DIG. 15

[56] References Cited

U.S. PATENT DOCUMENTS

| | | | |
|---|---|---|---|
| D. 284,738 | 7/1986 | Stone . | |
| D. 344,014 | 2/1994 | Marshall . | |
| 372,655 | 11/1887 | Cashin . | |
| 672,060 | 4/1901 | Goodnow et al. | 292/339 |
| 837,595 | 12/1906 | Storr | 292/339 X |
| 1,042,329 | 10/1912 | Daniels . | |
| 1,154,148 | 9/1915 | West | 292/343 |
| 1,353,543 | 9/1920 | Schoelkopf | 292/339 |
| 4,630,854 | 12/1986 | Persson et al. | 292/343 |
| 5,199,759 | 4/1993 | Anderson | 292/DIG. 15 X |

FOREIGN PATENT DOCUMENTS

| | | | |
|---|---|---|---|
| 166153 | 3/1934 | Switzerland | 292/343 |

*Primary Examiner*—Rodney M. Lindsey

*Attorney, Agent, or Firm*—Middleton & Reutlinger; John F. Salazar

[57] ABSTRACT

The present invention is for a portable two piece door stop which can be readily assembled and disassembled. The doorstop is made of a first wedge member having a longitudinal slot formed therein which receives an engagement head of the second back support member. The back support member is comprised of said engagement head formed at one end and at the opposite end a first and a second spur to prevent the assembled doorstop from sliding backwards should an abutting door attempt to be opened.

5 Claims, 2 Drawing Sheets

TWO PIECE PORTABLE DOORSTOP

BACKGROUND OF THE INVENTION

1. Field Invention

The present invention relates to door stops and more particularly to door stops which are easily portable and adequately prevent a closed door from being opened.

2. Discussion of the Prior Art

Various types of doorstops are well known. Doorstops are typically designed to provide adequate resistance to horizontal force applied to the door in an attempt to open said door. Usually, a long shaft having a u-shaped member is wedged underneath the doorknob. At the other end of the shaft is located an anti-slip material to prevent the shaft from moving. This design proves disadvantageous in that storing and moving the doorstop is difficult. Alternatively, a smaller wedge shaped article may also be used to keep the door closed but at a cost of providing less effective means to keep the door shut. Typically, a wedge shaped article is used and forced under a door between the bottom of the door and the ground. These types of doorstops typically provide little if any security as they tend to slide along the ground surface w hen sufficient horizontal force is applied to the door. Also, these smaller doorstops tend to be less effective at preventing a door from opening upon sufficient pressure being applied to the door.

SUMMARY OF THE INVENTION

The present invention is for a two piece portable doorstop. One object of the present invention is to provide a doorstop which is small and effective at preventing a door from being opened. It is another object of the present invention to provide a doorstop with two independent pieces so that the entire doorstop may be disassembled and stored in a relatively flat manner.

More particularly, an object of the present invention is to provide a two piece doorstop which is made of a solid material strong enough to withstand the forward pressure of a door being forcibly opened. It is a further object of the present invention to provide a doorstop which has means to prevent backward sliding of the doorstop should forcible opening of the door be attempted.

Finally, the present invention comprises an a two piece doorstop comprised of a wedge member having a longitudinal slot formed therein and a back support member removably attached to said wedge member.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figures 1, 1A:
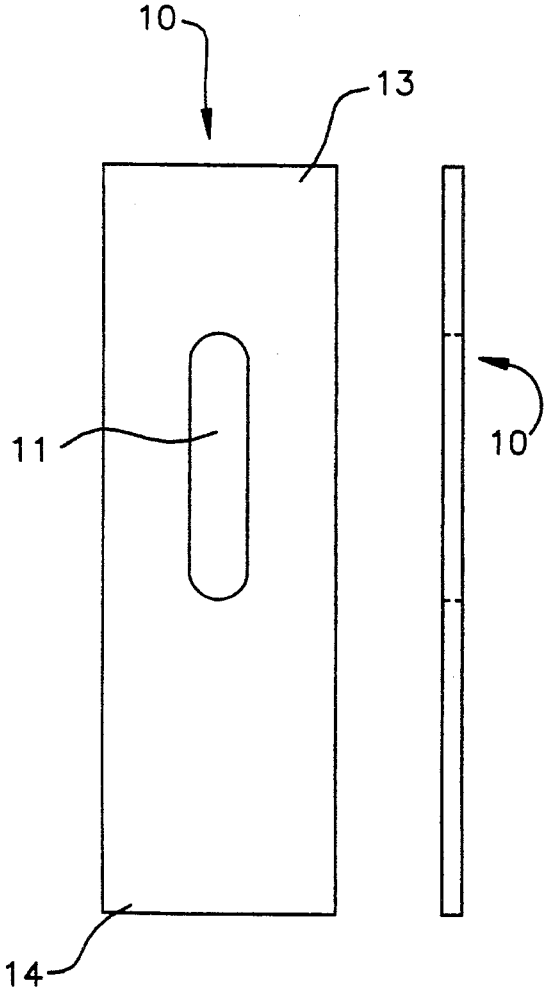
FIG. 1 is a top view of the wedge member of the doorstop of the present invention.
FIG. 1A is a side view of the wedge member displayed in FIG. 1.
Figures 2, 2A:
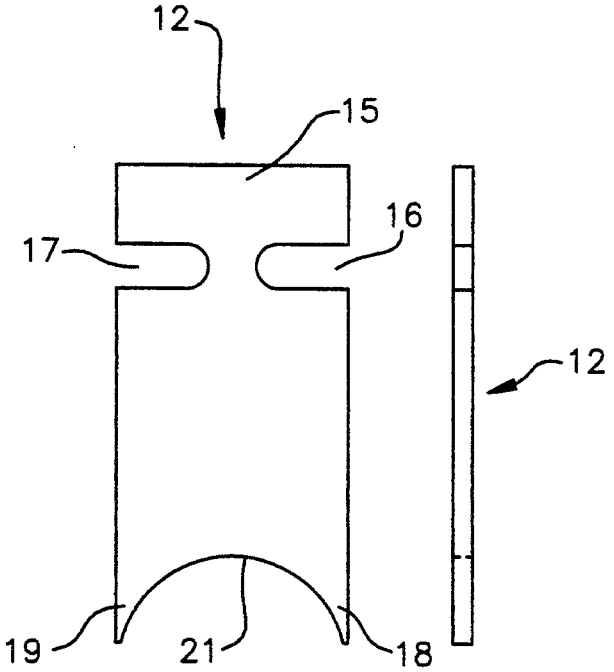
FIG. 2 is a top view of the back support member of the doorstop of the present invention.
FIG. 2A is a side view of the back support member displayed in FIG. 2.
Figure 3:
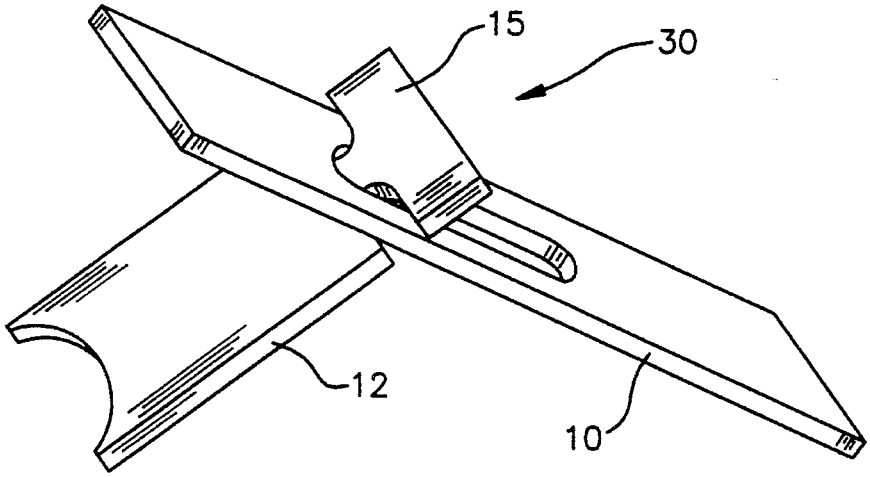
FIG. 3 is a perspective view of the assembled doorstop of the present invention; and, FIG. 4 is a perspective view of the assembled doorstop of the present invention with abutting door in contact with the doorstop.

The doorstop 30 of the present invention is composed of two pieces, the first wedge member 10 shown in FIG. 1 and the second back support member 12 shown in FIG. 2. Wedge member 10 is the front facing piece which abuts directly against the lower edge of a door 20, shown i n FIG. 4, and is substantially rectangular in shape. Front facing wedge member 10 has a longitudinal slot 11 formed therein, said slot formed within wedge member 10 closer to one end of said member 10 so that it is not quite centrally disposed therein. The end 13 where said slot 11 is formed is the rear end of the wedge member. The opposite end 14 of the wedge member 10 is the edge which is inserted beneath the door frame. The entire front surface of wedge member 10 is held upright at an inclined angle, as shown in FIG. 3, which requires the slot 11, as previously described, to be formed closer to the back edge 13 of the wedge member.

Figure 4:
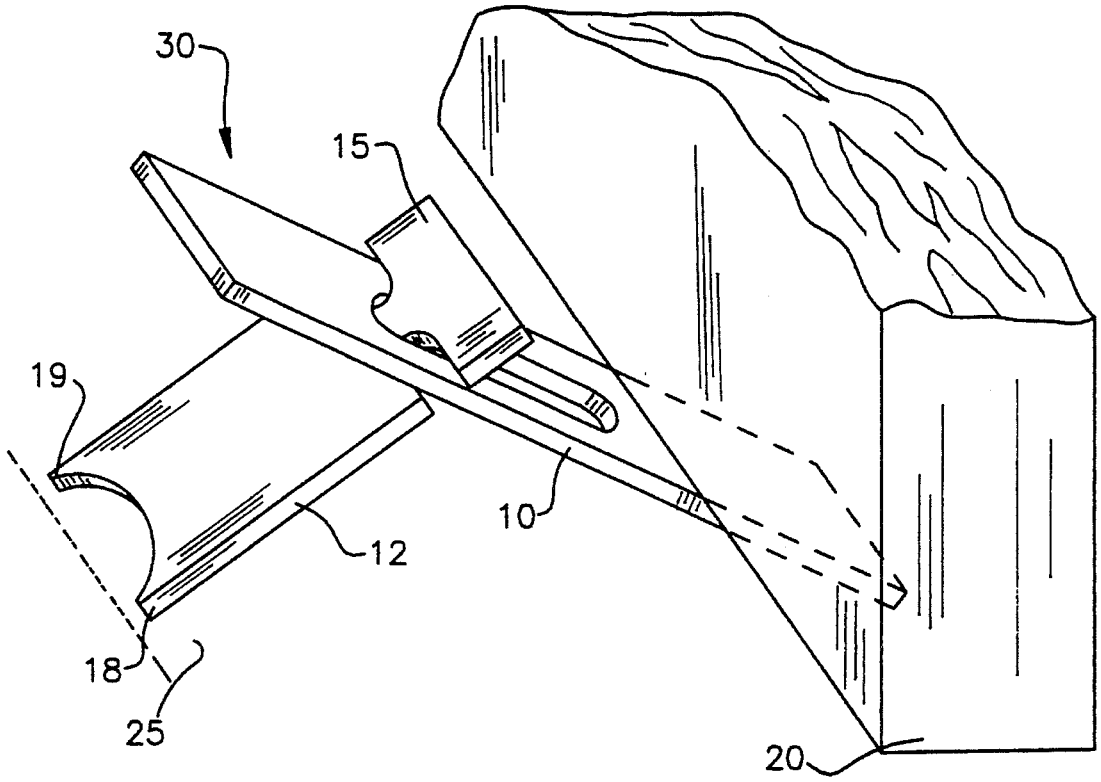

Slot 11 of the wedge member 10 receives back support member 12. Back support member 12 has formed at one end a square engagement head 15 which is inserted into slot 11 of wedge member 10. Back support member 12 has shoulders 16 and 17 formed directly below engagement head 15 so that back support member 12 may be locked into place within slot 11 of wedge member 10. In order to properly connect back support member 12 to wedge member 10, head 15 is rotated to match the diameter of slot 11, inserted through said slot 11, then rotated 90° so that the first member 10 and second member 12 form a V-Shaped obtuse angle between each other. Once formed, the two pieces which form doorstop 30 may be inserted in front of a door to prevent said door from being opened, as shown in FIG. 4.

Returning to FIG. 2, back support member 12 has spurs 18 and 19 formed thereon in order to prevent back sliding of the doorstop 30. Spurs 18 and 19 provide a means to prevent said doorstop 30 from sliding backward as a result of forward force brought by door 20. Formed into back support member 12 therefore is u-shaped concave indentation 21 having on each end spurs 18 and 19. Spurs 18 and 19 are sharp enough such that any rearward pressure placed against wedge member 10 by door 20 causes spurs 18 and 19 to become imbedded into the floor or support surface 25 thereby preventing the doorstop 30 from sliding backwards. Therefore, increased forward pressure on the doorstop 30 from the door 20 is transferred to spurs 18 and 19 in downward force preventing the doorstop 30 from moving.

Preferably, the doorstop 30 may be made of steel or other hardened material in order to withstand high amounts of pressure exerted from a door. Slot 11, spurs 18 and 19 and shoulders 16 and 17 may be formed into members 10 and 12 either by machining or other methods. Each member 10 and 12 may be approximately ⅛" thick and 1½ wide. The small size of both members allows the doorstop 30 to be easily carried while also being resistant to bending.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A two piece doorstop, comprising:

a wedge member, said wedge member substantially rectangular and having a longitudinal slot formed therein;

a second back support member having a rectangular engagement head at one end and a first and a second spur at the opposite end, said rectangular engagement head inserted into said longitudinal slot of said wedge member;

wherein said wedge member forms an upwardly angled surface which abuts against the lower edge of a door preventing said door from being opened.

2. The doorstop of claim 1 wherein said back support member has a first and a second shoulder formed directly below said engagement head.

3. The doorstop of claim 1 wherein said back support member has a concave indentation formed between said first and said second spur.

4. A two piece doorstop, comprising:

a first wedge member, said wedge member substantially rectangular and having a longitudinal slot formed therein;

a second back support member having a square engagement head at one end and having a first and second shoulder formed directly there below, a first and a second spur at the opposite end with a concave indentation formed therebetween, said square engagement head inserted into said longitudinal slot of said wedge member;

whereby said first wedge member and said second back support member form an obtuse angle therebetween.

5. In combination with a door, a two piece doorstop inserted below the lower edge of said door, comprising:

an upwardly angled rectangular wedge member, said wedge member having a longitudinal slot formed therein and abutting against the lower edge of said door;

a back support member having a rectangular engagement head at one end, a first and a second spur at the opposite end and a first and second shoulder directly below said engagement head, said engagement head inserted through said longitudinal slot of said wedge member such that said first and second shoulder support said wedge member;

whereby opening said door causes said wedge member to compress downward against said first and second shoulder causing said first and second spur to prevent backward movement of said two piece door stop.

* * * * *